US005413384A

United States Patent [19]

Principe et al.

[11] Patent Number: 5,413,384

[45] Date of Patent: May 9, 1995

[54] COMPOSITE LABEL FOR USE IN COUPONING

[75] Inventors: Terry J. Principe; Paul S. Schultz, both of Miamisburg, Ohio

[73] Assignee: Monarch Marking Systems, Inc., Dayton, Ohio

[21] Appl. No.: 28,080

[22] Filed: Mar. 8, 1993

[51] Int. Cl.[6] ..... G09F 3/02

[52] U.S. Cl. ..... 283/81; 283/101; 283/103; 283/901; 283/51; 206/831; 428/42; 428/43; 428/916

[58] Field of Search ..... 283/101, 103, 109, 81, 283/901, 51; 462/26, 2, 6; 206/831, 807; 428/43, 40, 42, 916; 40/168, 630

[56] References Cited

U.S. PATENT DOCUMENTS

| | | | |
|---|---|---|---|
| 3,166,186 | 1/1965 | Karn | 428/42 |
| 3,226,862 | 1/1966 | Gabruk | 40/638 |
| 3,524,782 | 8/1970 | Buske | 428/43 X |
| 4,323,608 | 4/1982 | Denny et al. | 428/43 |
| 4,551,373 | 11/1985 | Conlon | 40/638 X |
| 4,621,442 | 11/1986 | Mack | 283/81 X |
| 4,767,654 | 8/1988 | Riggsbee | 428/40 |
| 4,821,439 | 4/1989 | Wilck | 40/638 |
| 4,837,956 | 6/1989 | Dolence | 40/299 |
| 4,846,504 | 7/1989 | Mac Gregor et al. | 283/81 X |
| 4,889,367 | 12/1989 | Miller | 283/81 X |
| 4,927,179 | 5/1990 | Ehret et al. | 283/81 X |
| 5,019,436 | 5/1991 | Schramer et al. | 428/40 |
| 5,100,180 | 3/1992 | Tucker | 283/903 X |
| 5,106,124 | 4/1992 | Volkman et al. | 283/81 |
| 5,240,789 | 8/1993 | Breen et al. | 40/638 X |

FOREIGN PATENT DOCUMENTS

| | | | |
|---|---|---|---|
| 0276006 | 7/1988 | European Pat. Off. | 40/638 |
| 4019126 | 12/1991 | Germany | 40/638 |
| 2159118 | 11/1985 | United Kingdom | 40/638 |

*Primary Examiner*—Mark Rosenbaum
*Assistant Examiner*—Frances Han
*Attorney, Agent, or Firm*—Joseph J. Grass

[57] ABSTRACT

A method of couponing utilizes a coupon comprised of a label material layer or sheet and an underlay material layer or sheet releasably adhered by non-tacky adhesive. The underlay sheet has a coating of pressure sensitive adhesive to which a release liner is releasably adhered. The coupon can carry a bar code which is not scannable when the coupon is adhered to merchandise, however, the bar code can be scanned when a portion of the coupon is removed and presented for redemption.

17 Claims, 4 Drawing Sheets

COMPOSITE LABEL FOR USE IN COUPONING

BACKGROUND OF THE INVENTION

1. Field of the Invention

This invention relates to the couponing art in general, and to composite labels and composite label webs for use in couponing, to method of making composite label webs for use in couponing and to methods of couponing in particular.

2. Brief Description of the Prior Art

Prior to the invention, coupons in the form of piggy-back labels have been used to show a discount which a purchaser earns when purchasing merchandise. The top label of the piggy-back label can carry the discount amount, and that top label can be redeemed at the check-out counter. Some prior art coupons carry a bar code which indicates the product for which the discount amount is being given and the discount amount. The bar code on the coupon can be scanned at the check-out counter to cause automatic deduction of the discount amount from other charges.

SUMMARY OF THE INVENTION

In accordance with the invention, there is provided a low-cost, user-friendly, simple, easy-to-use method of couponing, method of making composite labels, method of making composite label webs and composite label webs per se which represent an advance in the couponing art.

One object of the invention is to provide an improved method of couponing wherein the bar code on the coupon will not interfere with scanning of the bar code on the merchandise when scanned at the checkout counter.

Another object of the invention is to provide an improved coupon which provides the user with a label or coupon which bears not only the human-readable price, but also the product identifier and the price in machine-readable form, as well as information as to the rules for redemption of the coupon.

It is yet another object of the invention to provide an improved coupon or composite label which enables the composite label to be applied to merchandise, and whereupon removal of one portion of the composite label from the merchandise, a remaining portion of the composite label stays adhered to the merchandise and indicates that the one portion has been removed.

It is still a further object of the invention to provide a composite label in which a portion of the composite label which bears the bar code can be folded-under another portion of the composite label so that the bar code containing the discount amount cannot be scanned inadvertently.

DETAILED DESCRIPTION OF THE PREFERRED EMBODIMENT

Figure 1:
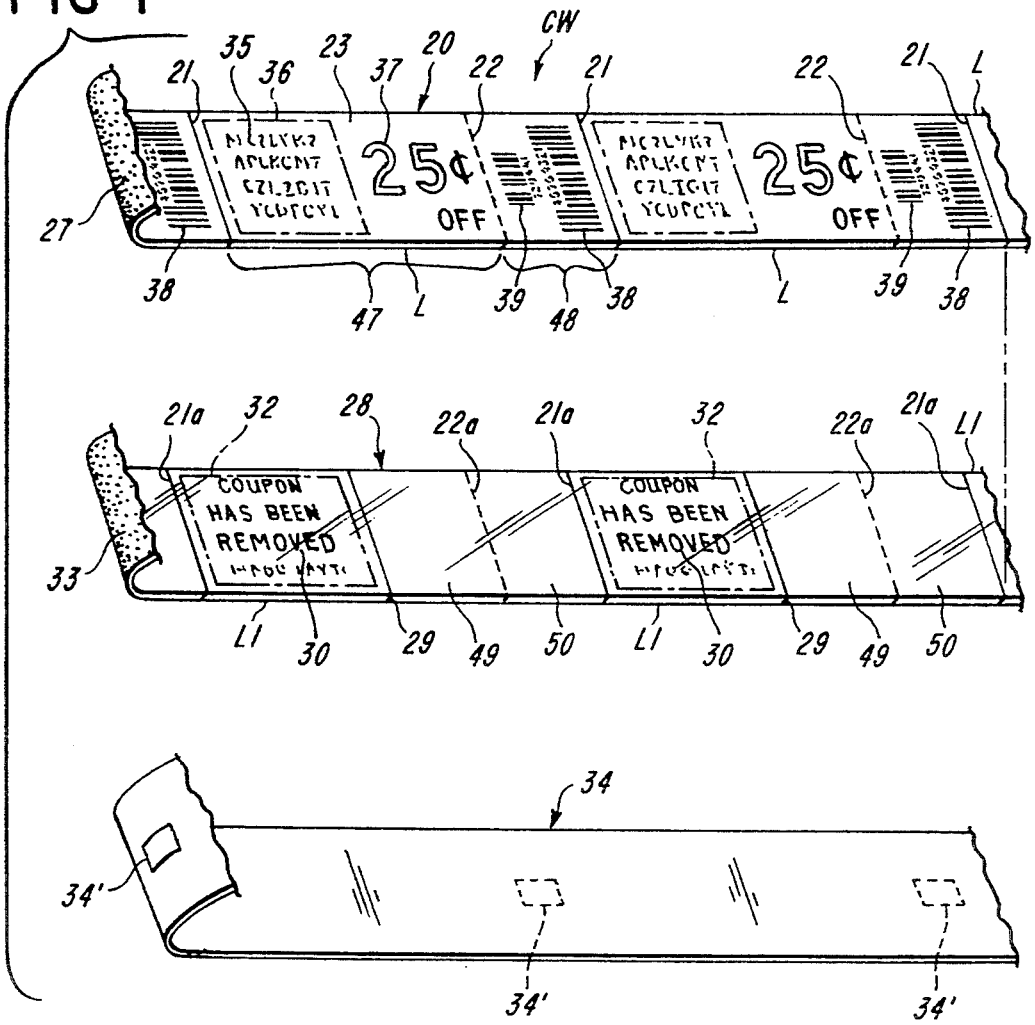
FIG. 1 is an exploded perspective view of a web of coupons or composite labels in a composite label web.
Figure 9:
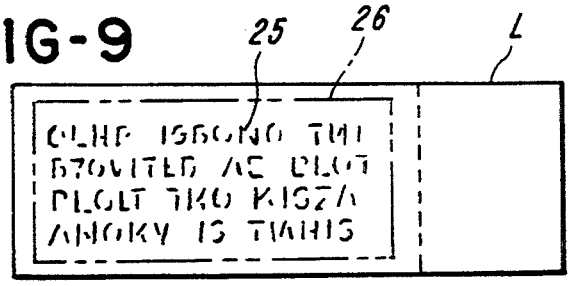
FIG. 9 is a bottom plan reduced-size view of only the label which forms the top layer of the coupon.
Figure 10:
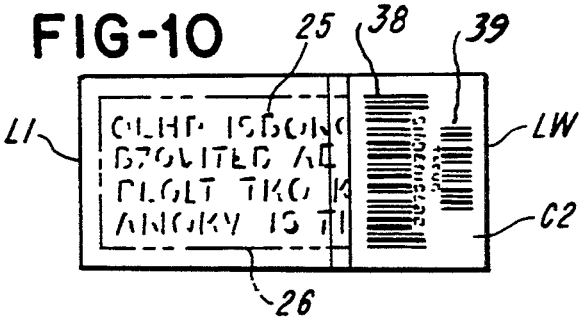
FIG. 10 is a bottom plan view of the portion of the coupon which has been removed from the merchandise, with a second label part folded under and adhered to a first label part.
Figure 11:
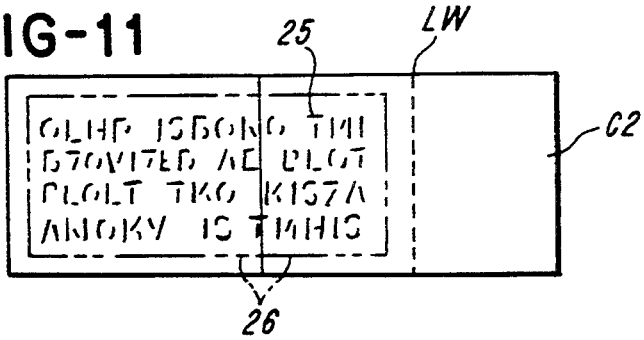
FIG. 11 is a view similar to FIG. 10, but showing the portion of the label of the second label part as having been unfolded from the first label part.

Referring to FIG. 1, there is shown a coupon web or composite label web CW. There is a longitudinally extending label material web generally indicated at 20 which has been completely severed by lateral or transverse, equally and longitudinally spaced lines of complete severing 21 extending across the web 20. The complete severing 21 divides the web 20 into layers or sheets of labels L. Spaced between each adjacent pair of lines of severing 21 is a lateral or transverse line of weakening comprised of partial severing 22. The partial severing 22 can be made by a perforating knife (not shown). The partial severing 22 is made at equally longitudinally spaced intervals. The lines of complete severing 21 and the lines of partial severing 22 are parallel. The outer or top surface 23 of the web 20 has a coating (not shown) suited to the type of printing which the outer surface 23 is to receive. In this particular embodiment the coating would be a thermal coating so that various indicia can be printed on the outer surface by a thermal type of printer indicated at P in FIG. 3 and also by a printer which can print patterns using conventional inks. The under or lower surface 24 of the web 20 is ink receptive and receives printed indicia 25 in an area or zone 26 on the underside of each label L as shown in FIGS. 9, 10 and 11. The indicia 25 set forth terms and conditions of the coupon offer. The same printed indicia 25 in area 26 occurs in the same place on each label L, and thus the indicia occur at equally longitudinally spaced intervals. There is a dry-tack or non-tacky adhesive 27 shown on the undersurface 24. The indicia 25 lie between the label material 20 and the adhesive 27.

Figure 13:
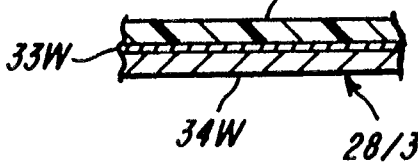
FIG. 13 is a sectional view taken along line 13—13 of FIG. 12.

The coupon web CW also includes an intermediate or underlay material web generally indicated at 28. The web 28 is completely severed along lateral or transverse, parallel lines of complete severing 21*a* which coincide with the lines of complete severing 21. The web 28 is weakened by lateral or transverse lines of weakening made by lines of partial severing 22*a*. The partial severing 22*a* can be made by a perforating knife roll 88 shown in FIG. 13. The lines of partial severing 22 in the web 20 and the lines of partial severing 22*a* in the web 28 coincide. The web 28 also has lateral or transverse lines of complete severing 29. Each line of complete severing 29 is disposed between a line of complete severing 21*a* and an adjacent line of partial severing 22*a*. The lines of complete severing 29 are parallel and made at equally longitudinally spaced intervals. Each adjacent pair of lines of complete severing 21*a* and 29 defines a layer or sheet, namely, a label L1. It is preferred that the underlay material web 28 be made of transparent material and that printed indicia 30 be printed on upper or top surface 31 of the web 28. The printed indicia 30 are applied in an area or zone 32. The printed indicia 30 are printed at equally longitudinally spaced intervals. A coating of pressure sensitive adhesive 33 is provided on undersurface 31' of the web 28. Typical wording of the indicia 30 is:

Coupon Has Been Removed

A store coupon to give you an additional savings was attached to this carton. If it is missing, please call it to the attention of the store manager.

The coupon web CW is illustrated as including a longitudinally extending, release-coated carrier web or release liner generally indicated at 34. The underside of the release liner 34 is printed with marks 34' used for accurately registering the coupon web CW with the printer P.

As shown in FIG. 1, the outer surface 23 of the web 20 can be printed with indicia 35 in a zone or area 36, printed human-readable indicia 37 can be applied to outer surface 23 between the zone 36 and the partial severing 22. Also machine-readable information such as a product identifying bar code 38 can be applied adjacent line of complete severing 21 and the discount amount also in the form of a bar code 39 can be applied between partial severing 22 and the bar code 38.

Figure 3:
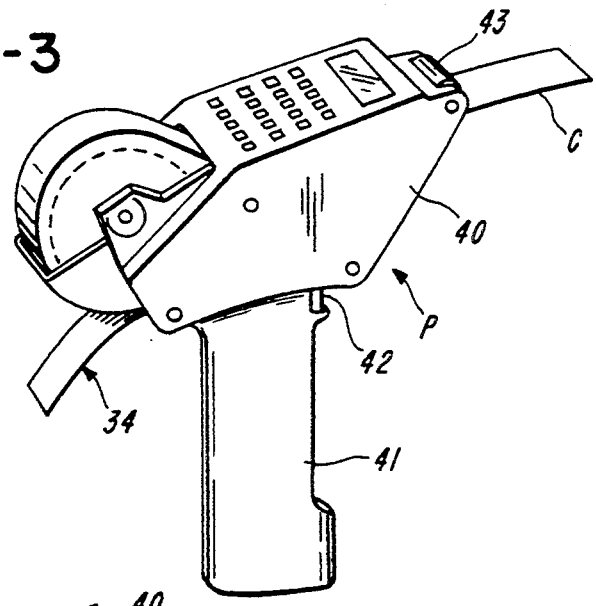
FIG. 3 is a perspective view of a hand-held labeler which can be used to print and dispense coupons in accordance with the invention.
Figure 4:
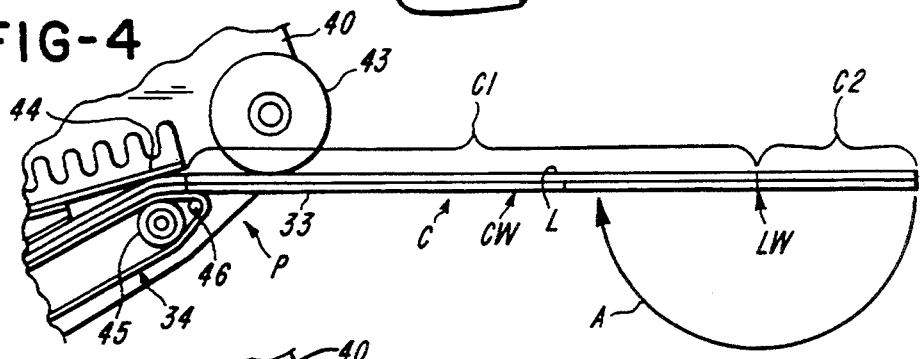
FIG. 4 is a fragmentary broken-away view of the labeler depicted in FIG. 3, showing the manner in which a printed coupon is dispensed.

FIGS. 3 AND 4 illustrate a manner in which a coupon C can be printed and dispensed by a user. The printer P can be of a construction as illustrated in U.S. Pat. No. 4,956,045 granted Sep. 11, 1990 and assigned to Monarch Marking Systems, Inc. The printer P has a housing 40 with a manually graspable handle 41, a trigger or actuator 42, an applicator roll 43, a thermal print head 44, a platen roll 45, and a delaminator 46. The coupon C comprises the coupon web CW without the carrier web 34.

Figure 6:
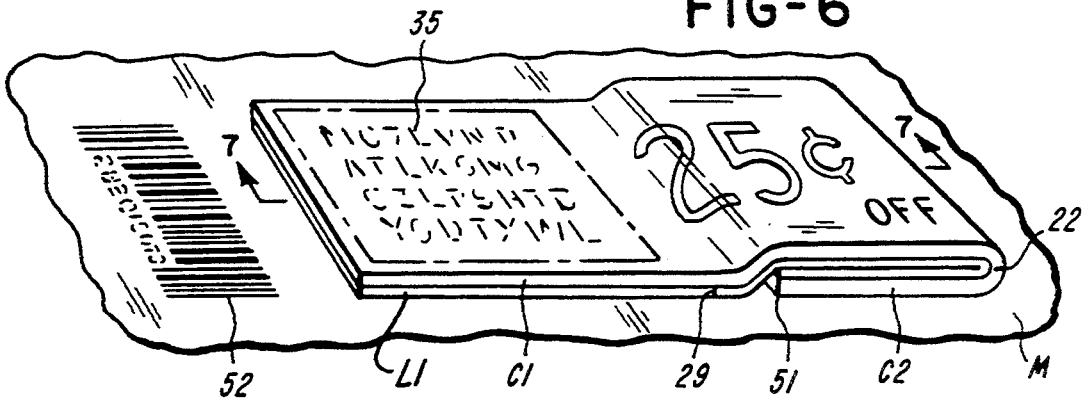
FIG. 6 is a perspective view showing the coupon applied to merchandise.
Figure 7:
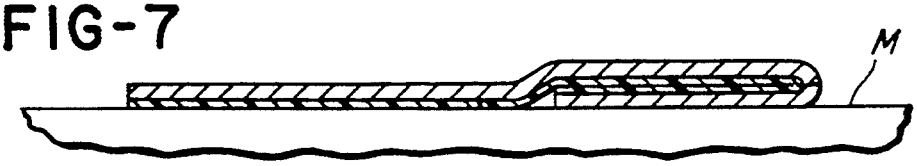
FIG. 7 is a sectional view taken generally along line 7—7 of FIG. 6.

With reference to FIGS. 1 and 4, the portion of the label L on one side of the partial severing 22 is considered to be a first label part 47 and the portion of the label L on the other side of the partial severing 22 is considered to be a second label part 48. The first label part 47 and the underlying label L1 and the underlying portion 49 of the underlay material web 28 are considered to be a first coupon part or composite first label part C1. The second label part 48 and the underlying portion 50 of the underlay material web 28 is considered to be a second coupon part or composite second label part C2. The composite first label part C1 is preferably at least twice as long as the composite second label part C2, and as shown in FIGS. 4 and 6, for example, is most preferably more than twice as long as the composite second label part C2.

Figure 2:
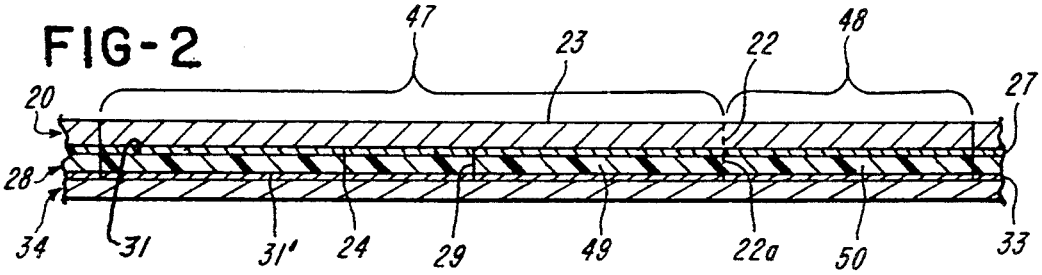
FIG. 2 is a longitudinal sectional view of the composite label web.

The printer P prints and dispenses a coupon C to the position shown in FIG. 4. The carrier web 34 passes about the delaminator 46 and exits the printer as shown in FIG. 3. The arrow A in FIG. 4 shows the manner in which the coupon C can be folded. Referring to FIGS. 1 and 2, it is seen that the weakening formed by the partial severing 22 and 22*a* is along the same line. Thus, there is a line of weakening LW at which the first and second coupon parts C1 and C2 are connected. As shown in FIG. 4, the second coupon part C2 can be folded or pivoted about the line of weakness LW as shown by arrow A into underlying relationship to the first coupon part C1 to the position shown in FIG. 5. In that the underlay material web 28 has a coating of pressure sensitive adhesive 33 on its underside, the second coupon part C2 is adhered to the underside of the first coupon part C1 as shown in FIG. 5.

Figure 5:
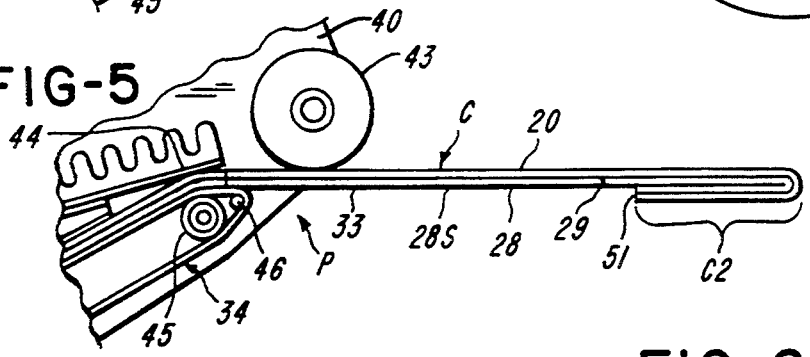
FIG. 5 is a view similar to FIG. 4, but showing a portion of the coupon folded under itself.

In the position shown in FIGS. 4 and 5, the trailing marginal edge of the coupon C is still adhered to the carrier web 34. When the coupon C has been folded into the position shown in FIG. 5, the user can grasp the second coupon part C2 and the overlying portion of the first coupon part C1 and pull the coupon C manually from the carrier web 34. Thereupon, the user can manually adhere the coupon C to merchandise M by means of the exposed adhesive 33 on the underside of the underlay sheet 28S. As shown, the exposed adhesive 33 extends under the entire label L1 including under the portion of the underlay material 28 between the line of complete severing 29 and the terminal end 51 of the second coupon part C2 as best shown in FIG. 6. Thus, the coupon C can be applied and securely held to the merchandise M. The merchandise M typically has a product identifying bar code 52 which can be scanned at the checkout counter to charge the customer for his/her purchase. It is evident from FIG. 6 that the bar codes 38 and 39 on the second coupon part C2 are not able to be scanned when the bar code 52 is scanned because the second coupon part C2 has been folded under. This prevents the scanner from inadvertently reading the codes 38 and 39 when the customer charge is being made. The bar code 52 is, however, capable of being scanned, at the checkout counter.

Figure 8:
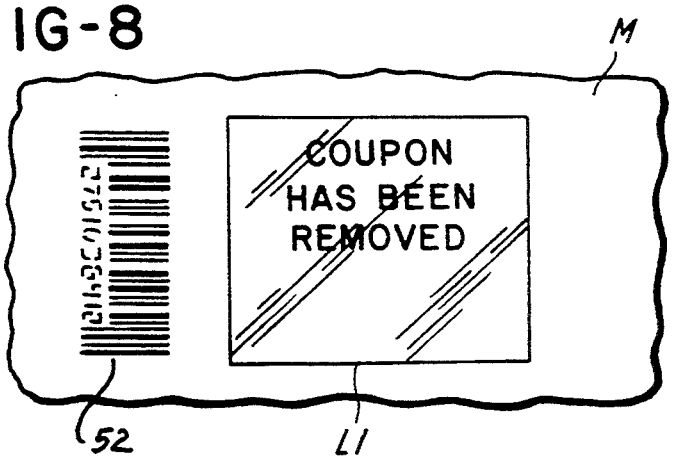
FIG. 8 is a top plan view of the merchandise shown in FIG. 6, but showing a portion of the coupon remaining adhered to the merchandise after another portion of the coupon has been removed.

In order to redeem the coupon C, the user or the checkout clerk grasps the second coupon part C2 and the adjacent portion of the first coupon part C1 to which the second coupon part C2 is adhered and attempts to remove the coupon C from the merchandise M. During such attempted removal, the label L1 remains adhered to the merchandise M as shown in FIG. 8. This evidences that the portion of the coupon C containing the bar codes 38 and 39 has been removed. Because the adhesive 27 which holds the label L to the label L1 is non-tacky, the label L1 cannot become stuck to other materials. In addition, the removed portion of the coupon C cannot readily be reapplied to the label L1, thereby reducing the possibility of fraud.

FIG. 10 shows the underside of the portion of the coupon C which has been removed from the merchandise and its associated label L1. It is evident that a portion of the printed indicia 25 is covered by the second coupon part C2. This is curable because the second coupon part C2 can be peeled back which causes separation at the dry-tack adhesive 27. The condition of the remainder of the coupon C (with the label L1 removed) wherein the second label part has been opened up or unfolded is shown in FIG. 11. The unfolding is accomplished by attempting to peel back the second coupon part C2 along the interface between the adhesive 33 on the panel 49 and the adhesive on the panel 50. The redeemed coupon can be scanned either in the condition shown in FIG. 10 or in the condition shown in FIG. 11.

A typical dry-tack or non-tacky adhesive is a formulated polyvinyl resin sold in emulsion form under No. 31-1556 by National Starch and Chemical Corporation, Adhesives Division, Bridgewater, N.J. 08807 U.S.A.

Figure 12:
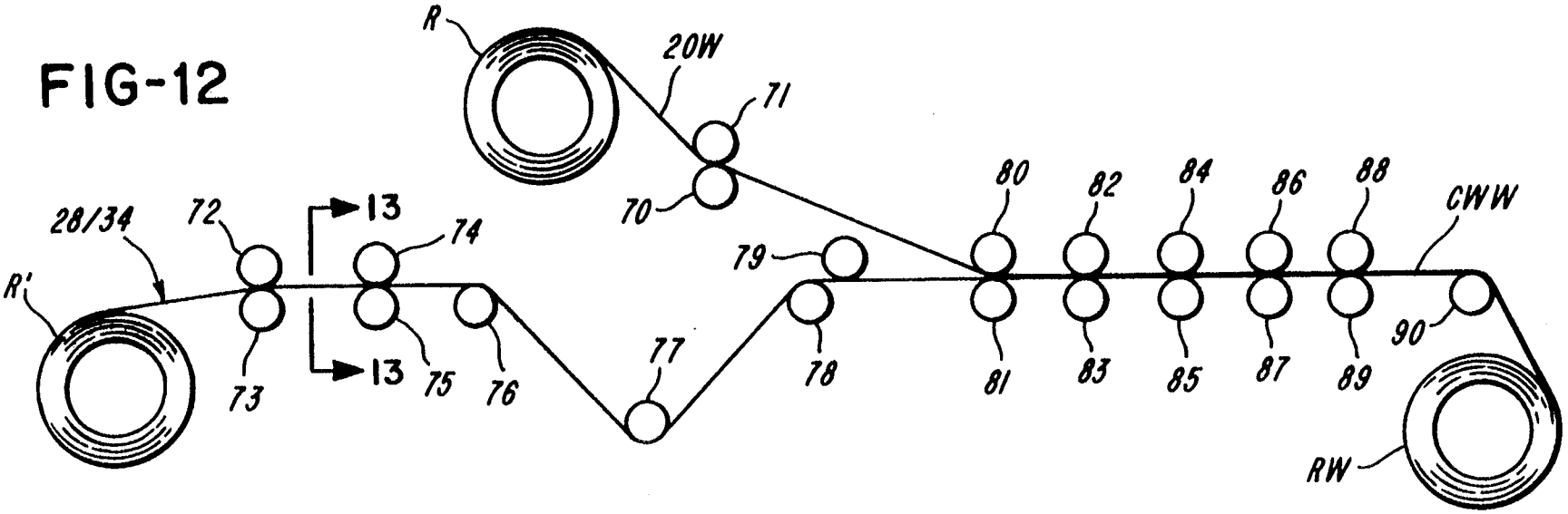
FIG. 12 is a diagrammatic view illustrating a method of making the composite label web of the invention.

The process of making the composite label web CW is diagrammatically illustrated in FIG. 12. A roll R is shown containing label material 20W for making the label material web 20. The label material 20W is paid out of the roll R to between cooperating rolls 70 and 71. The roll 70 prints indicia 25 at both laterally and longitudinally spaced intervals on the underside of the web 20W. A roll R' contains a web 28/34 which contains a wide web 28W of underlay material to which a wide web of carrier web 34W is adhered by pressure sensitive adhesive 33W. The indicia 30 are applied to the web 28W at both laterally and longitudinally spaced intervals by a printing roll 72 and a cooperating back-up roll 73.

The longitudinally spaced lines of complete severing 29 are made laterally across the web 28W by a knife roll 74 and a cooperating back-up roll 75. The web 28/34 is guided by rolls 76, 77 and 78 to a coating roll 79 which applied the dry tack adhesive 27 to the upper surface of the web 28/34. The web 20W is laminated to the web 28/34 by and between rolls 80 and 81. The web 20W can be printed with colors in different areas in a repeating pattern so that each label L has a field or fields. This color printing can be applied or coated by a printing roll 82 and a cooperating back-up roll 83. An ultraviolet overcoating roll 84 and a cooperating back-up roll 85 can be used to apply a suitable thermal coating to the web 20W if required. A lateral knife roll 86 and cooperating back-up roll 87 make the lateral partial severing 22 through the web 20W and through the web 28W. A lateral knife roll 88 and a cooperating back-up roll 89 make the lateral complete severing 21 through the label material web 20W and through the underlay web 28W. The severing 21 and the severing 21*a* which are along the same line are made simultaneously by means of the knife roll 88. The wide composite web CWW is guided by a roll 90 and wound into a roll RW. The roll RW is thereafter slit into narrow composite webs CW.

Other embodiments or modifications of the invention will suggest themselves to those skilled in the art, and all such of these as come within the spirit of this invention are included within its scope as best defined by the appended claims.

We claim:

1. A composite label for use in couponing, comprising: a sheet of printable label material, a sheet of underlay material having an underside, a coating of dry-tack adhesive releasably adhering the label material and the underlay material to each other, printed indicia on the underlay material, a coating of pressure sensitive adhesive on the underside of the underlay material, a line of complete severing across the underlay material to provide first and second underlay parts, and the printed indicia being on the first underlay part.

2. A composite label as defined in claim 1, the first overlay part having an upper surface, wherein the underlay material is transparent, the printed indicia being on the upper surface of the first underlay part.

3. A composite label as defined in claim 1, where the composite label includes a release liner releasably adhered to the pressure sensitive adhesive.

4. A composite label for use in couponing, comprising: a sheet of printable label material, a sheet of underlay material, a coating of dry-tack adhesive releasably adhering the label material and the underlay material to each other, a line of weakening in the label material and the underlay material to provide first and second composite label parts, wherein the second composite label part is smaller than the first composite label part, the label material of the second composite label part having an outer surface, printed machine-readable indicia on the outer surface of the label material of the second composite label part, wherein the second composite label part is foldable about the line of weakening to bring the second composite label part into underlying relationship with respect to the first composite label part, and pressure sensitive adhesive on the first composite label part for adhering the first label part to merchandise.

5. A composite label for use in couponing, comprising: a sheet of printable label material, a sheet of underlay material having an underside, a coating of dry-tack adhesive releasably adhering the label material and the underlay material to each other, a coating of pressure sensitive adhesive on the underside of the underlay material, and a release liner releasably adhered to the pressure sensitive adhesive.

6. A composite label as defined in claim 3, wherein the underlay material is transparent and has an upper surface, and printed indicia on the upper surface of the underlay material.

7. A composite label as defined in claim 5, the label material having an underside and printed indicia on the underside of the label material.

8. A composite label as defined in claim 3, wherein the underlay material is completely severed along a line of severing and immediately adjacent label material is free of complete severing.

9. A composite label as defined in claim 8, including a line of weakening in the label material and the underlying underlay material generally parallel to the line of severing to divide the composite label into composite first and second label parts, wherein the composite first label part is at least twice as long as the composite second label part.

10. A composite label as defined in claim 8, wherein the composite first label part is more than twice as long as the composite second label part.

11. A composite label for use in couponing, comprising: a sheet of printable label material, a sheet of underlay material adhered to the label material, wherein the underlay material is transparent, a line of complete severing across the underlay material for separating the underlay material into separable parts, the label material being free of complete severing immediately adjacent the line of complete severing in the underlay material, printed indicia on the underlay material, and a coating of pressure sensitive adhesive on the underside of the underlay material.

12. A composite label for use in couponing, comprising: a sheet of label material having a printable outer surface, a sheet of underlay material having an underside and adhered to the label material, a line of weakening in the label material and the underlay material to provide composite first and second label parts, wherein the composite second label part is smaller than the composite first label part, machine readable indicia on the outer surface of the label material of the composite second label part, wherein the composite second label part is foldable about the line of weakening to bring the composite second label web into underlying relationship with respect to the composite first label part, a line of complete severing across the underlay material for separating the underlay material into separable parts, the label material being free of complete severing immediately adjacent the line of complete in the underlay material, the line of complete severing being spaced from the line of weakening, printed indicia on the underlay material, and a coating of pressure sensitive adhesive on the underside of the underlay material.

13. A composite label for use in couponing, comprising: a sheet of label material having printable outer and under surfaces, a sheet of transparent underlay material having an undersurface, a coating of dry-tack adhesive releasably adhering the label material and the underlay material to each other, printed indicia on the under surface of the label material, a line of weakening in the label material and the underlay material to provide composite first and second label parts, wherein the first label part is larger than the second label part, wherein the composite second label part is foldable about the line of weakening to bring the composite second label part into underlying relationship with respect to the composite first label part, a line of complete severing across the underlay material for separating the underlay material into separable parts, the label material being free of complete severing immediately adjacent the line of complete severing in the underlay material, the line of complete severing being spaced from the line of weakening, printed indicia on the underlay material, a coating of pressure sensitive adhesive on the under surface of the underlay material, and a release liner releasably adhered to the pressure sensitive material.

14. A composite label web having composite labels for use in couponing, comprising: a web of printable label material, means for separating the web of label material into labels, a web of underlay material having an undersurface and adhered to the web of label material, the web of label material being transparent, printed indicia on the undersurface of the underlay material in alignment with each label, a coating of pressure sensitive adhesive on the under surface of the web of underlay material, a web of release liner releasably adhered to the pressure sensitive adhesive, means on the release liner for registering the labels with a printer, means for completely severing the underlay material laterally to provide first and second underlay parts for each label, and printed indicia on each of the first underlay parts.

15. A composite label web as defined in claim 14, including a dry-tack adhesive releasably adhering the web of label material and the web of underlay material to each other, and printed indicia on the undersurface of each label.

16. A composite label web as defined in claim 15, including a line of weakening extending laterally across each composite label to provide each composite label with a composite first label part and a composite second label part connected to each other but enabling the composite second label part to be folded under the composite first label part after the release liner has been removed.

17. A composite label web having composite labels for use in couponing, comprising: a web of printable label material, a web of underlay material, dry-tack adhesive releasably adhering the web of label material and the web of underlay material to each other, means for separating the web of label material into composite labels, a coating of pressure sensitive adhesive on the undersurface of the web of underlay material, a line of complete severing in the underlay material under each label to provide first and second underlay parts, printed indicia on the first underlay parts, a web of release liner releasably adhered to the pressure sensitive adhesive, and a line of weakening extending laterally across each composite label to provide each composite label with a composite first label part and a composite second label part connected to each other but enabling the composite second label part to be folded under the composite first label part after the release liner has been removed.

* * * * *

UNITED STATES PATENT AND TRADEMARK OFFICE

CERTIFICATE OF CORRECTION

PATENT NO. : 5,413,384

DATED : May 9, 1995

INVENTOR(S) : Terry J. Principe and Paul S. Schultz

It is certified that error appears in the above-indentified patent and that said Letters Patent is hereby corrected as shown below:

Col. 6, line 20 "claim 3" should be --claim 5--.

Col. 6, line 27 "claim 3" should be --claim 5--.

Col. 6, line 68 after "complete --severing-- has been omitted.

Signed and Sealed this

Twenty-eighth Day of November 1995

*Attest:*

BRUCE LEHMAN

*Attesting Officer*

*Commissioner of Patents and Trademarks*